US008942608B2

(12) United States Patent
Tsuru et al.

(10) Patent No.: US 8,942,608 B2
(45) Date of Patent: Jan. 27, 2015

(54) FIXING UNIT AND IMAGE FORMING APPARATUS

(71) Applicants: Kenji Tsuru, Hachioji (JP); Yoshito Hashimura, Kawasaki (JP)

(72) Inventors: Kenji Tsuru, Hachioji (JP); Yoshito Hashimura, Kawasaki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 41 days.

(21) Appl. No.: 13/848,793

(22) Filed: Mar. 22, 2013

(65) Prior Publication Data

US 2013/0266351 A1 Oct. 10, 2013

(30) Foreign Application Priority Data

Apr. 10, 2012 (JP) ..... 2012-089186

(51) Int. Cl.
*G03G 15/20* (2006.01)
*G03G 15/00* (2006.01)

(52) U.S. Cl.
CPC ..... *G03G 15/50* (2013.01); *G03G 15/2028* (2013.01)
USPC ..... 399/323; 399/322; 399/399

(58) Field of Classification Search
USPC ..... 399/122, 322, 323, 399, 361
See application file for complete search history.

(56) References Cited

U.S. PATENT DOCUMENTS

| | | | | |
|---|---|---|---|---|
| 5,406,363 | A * | 4/1995 | Siegel et al. | 399/323 |
| 6,678,496 | B1 * | 1/2004 | Aslam et al. | 399/323 |
| 7,062,211 | B2 * | 6/2006 | Baba et al. | 399/323 |
| 2009/0304419 | A1 * | 12/2009 | Roof et al. | 399/323 |
| 2011/0222921 | A1 * | 9/2011 | Murakami et al. | 399/323 |
| 2011/0229220 | A1 * | 9/2011 | Yamamoto et al. | 399/323 |
| 2012/0063822 | A1 * | 3/2012 | Funabiki et al. | 399/323 |
| 2012/0282002 | A1 * | 11/2012 | Murasaki | 399/329 |

FOREIGN PATENT DOCUMENTS

JP 2004-053842 A 2/2004

* cited by examiner

*Primary Examiner* — Francis Gray
(74) *Attorney, Agent, or Firm* — Lucas & Mercanti, LLP

(57) ABSTRACT

The print performance of an image forming apparatus is improved by adequately estimating the behavior of a sheet receiving separation air and controlling the output of separation air. A fixing control unit 50 controls a shutter drive unit 52 defining the flow passage area on the basis of the displacement detected of the separation claw 42 to control the output of separation air. Since the sheet receiving separation air exerts a force on the separation claw 42, it is possible to estimate whether or not the behavior of the sheet is appropriate by monitoring the displacement of the separation claw 42. While different types of paper may move in different ways, the influence of separation air is dominant in the behavior of a sheet which is conveyed, and therefore the sheet can be prevented from moving in an inappropriate condition by controlling the output of separation air.

12 Claims, 5 Drawing Sheets

FIXING UNIT AND IMAGE FORMING APPARATUS

CROSS-REFERENCE TO RELATED APPLICATIONS

The present application claims priority under 35 U.S.C. §119 to Japanese Patent Application No. P2012-89186, filed Apr. 10, 2012. The contents of this application are herein incorporated by reference in their entirety.

FIELD OF INVENTION

The present invention relates to a fixing unit and an image forming apparatus equipped with this fixing unit.

DESCRIPTION OF RELATED ART

Conventionally, image forming apparatuses such as printers, copying machines and so forth are known as electrophotographic systems. Such an image forming apparatus performs a series of processes including transferring an image to a sheet, and then fixing the image to the sheet by passing the sheet through a fixing nip portion formed between a pair of fixing members. Incidentally, in this type of fixing unit, there may occurs the shortcoming that a sheet cannot be separated from the fixing member around which the sheet is wound even after passing through the fixing nip portion. The so-called air separation is therefore known as a technique of separating a sheet from a fixing member by blowing separation air. This air separation technique is often performed by adjusting the output of separation air in accordance with the paper type and the image pattern.

Other than this air separation, a separation claw is known for use in a technique of separating a sheet from a fixing member. For example, Japanese Patent Published Application No. 2004-53842 discloses a fixing unit having a separation claw for separating a sheet from a release layer of a heating fixing member with a pressure detecting device provided at an edge of the separation claw, which comes in contact with the heating fixing member, for detecting the pressure applied thereto. It is intended here to remove the cause of fixing failure and then prolong the life of a heating fixing roller by arranging a means for detecting the contact pressure at the edge of the separation claw.

However, even if the output of separation air is adjusted in accordance with the paper type and the image pattern, the sheet may sometimes move in an unexpected manner so that the print performance may be reduced. For example, there are the shortcomings that when separation air is too strong against a sheet, the image is scraped by interfering with a conveying guide at one surface of a sheet opposite the other surface catching the separation air, and that if a sheet too strongly abuts onto the separation claw, abrasion of the separation claw is accelerated at the abutting portion. On the other hand, when separation air is too weak against a sheet, there are the shortcomings that the image is scraped by interfering with a conveying guide at the other surface of a sheet catching the separation air and that the sheet is wound around the fixing member to cause a paper jam.

The present invention has been made in order to solve the shortcomings as described above. It is an object of the present invention therefore to improve the print performance of an image forming apparatus by adequately estimating the behavior of a sheet receiving separation air and controlling the output of separation air.

SUMMARY OF THE INVENTION

To achieve at least one of the abovementioned objects, a fixing unit reflecting one aspect of the present invention comprises: a fixing unit having a pair of fixing members engaged with each other under pressure to form a fixing nip portion through which a sheet is passed to fix an image to this sheet; an air blowing unit configured to output separation air for separating the sheet passed through said fixing nip portion from said fixing member; an adjusting unit configured to adjust the output of said separation air; a separation claw configured to separate the sheet passed through said fixing nip portion from said fixing member; a detecting unit configured to detect the displacement of said separation claw; a control unit configured to control the output of said separation air by controlling said adjusting unit on the basis of the displacement of said separation claw detected by said detecting unit.

It is preferred here that said separation claw supported by a resilient member in a predetermined base position, and designed to be displaced from the predetermined base position with said resilient member being resiliently deformed by a force which is exerted on said separation claw by the sheet.

Also, it is preferred that said air blowing unit comprises: an air blower configured to blow air; and a duct configured to lead the air blown from said air blower to an outlet opening, wherein said adjusting unit is a shutter member which changes the flow passage area of said duct.

Furthermore, it is preferred that said air blowing unit is an air blower which blows a fluid by rotating a fan, wherein said adjusting unit is a brake member which adjusts the rotational speed of said fan through the frictional resistance with the rotation shaft of said fan.

Furthermore, it is preferred that said air blowing unit is an air blower which blows a fluid by rotating a fan with an electric motor, wherein said adjusting unit is a regenerative brake which adjusts the rotational speed of said fan by converting rotational energy into electrical energy in said electric motor.

Furthermore, it is preferred that the output control of said separation air on the basis of the displacement of said separation claw detected by said detecting unit is used to control separation air blowing against a sheet subsequent to the sheet that caused the displacement of said separation claw.

BRIEF DESCRIPTION OF THE DRAWINGS

DETAILED DESCRIPTION OF THE PREFERRED EMBODIMENT (First Embodiment) FIG. 1 is a view for schematically showing the configuration of an image forming apparatus according to the present embodiment. This image forming apparatus is a copying machine which is an electrophotographic image forming apparatus called a tandem color image forming apparatus. The tandem color image forming apparatus includes a plurality of photoreceptor drums vertically arranged in contact with one intermediate transfer belt to form full-color images.

Figure 1:
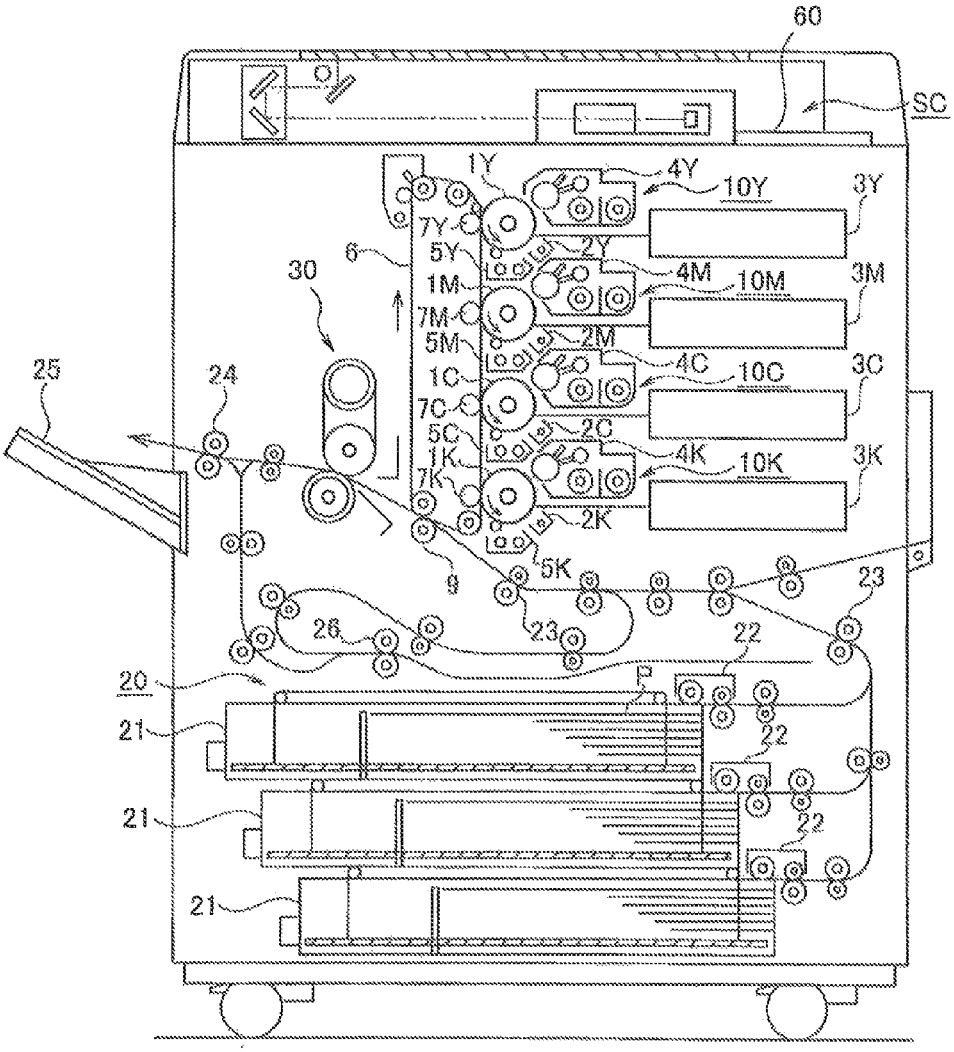
FIG. 1 is a view for schematically showing the configuration of an image forming apparatus according to a first embodiment of the present invention.

The image forming apparatus consists mainly of an original reading unit SC, four image forming units 10Y, 10M, 10C and 10K, a paper feed unit 20 and a fixing unit 30 which are installed within one housing.

The original reading unit SC scans and exposes the image of an original with an optical system of a scanning exposing device, and reads the reflected light therefrom with a line image sensor to obtain image signals. The image signals are processed by performing A/D conversion, shading compensation, data compression and so on and input to a control unit (not shown) as image data. Incidentally, the image data input to the control unit is not limited to the image data as captured by the original reading unit SC, but can be the data for example as received from another image forming apparatus, a personal computer or the like connected to the image forming apparatus.

The four image forming units 10Y, 10M, 10C and 10K are an image forming unit 10Y for forming yellow (Y) images, an image forming unit 10M for forming magenta (M) images, an image forming unit 10C for forming cyan (C) color images, and an image forming unit 10K for forming black (K) images.

The image forming unit 10Y is provided with a photoreceptor drum 1Y, and a charging unit 2Y, an optical writing unit 3Y, a development apparatus 4Y and a drum cleaner 5Y which are arranged around the photoreceptor drum 1Y. Likewise, the other image forming units 10M, 10C and 10K are provided with photoreceptor drums 1M, 1C and 1K, and charging units 2M, 2C and 2K, optical writing units 3M, 3C and 3K, development apparatuses 4M, 4C and 4K, drum cleaners 5M, 5C and 5K which are arranged around the photoreceptor drums 1M, 1C and 1K respectively.

The surfaces of the photoreceptor drums 1Y, 1M, 1C and 1K are uniformly charged with electricity by the charging units 2Y, 2M, 2C and 2K, and the optical writing units 3Y, 3M, 3C and 3K performs a scanning exposure process to form latent images on the photoreceptor drums 1Y, 1M, 1C and 1K. The development apparatuses 4Y, 4M, 4C and 4K then make visible the latent images on the photoreceptor drums 1Y, 1M, 1C and 1K by developing the images with toners. Toner images are thereby formed on the photoreceptor drums 1Y, 1M, 1C and 1K respectively corresponding to predetermined color components, i.e., yellow, magenta, cyan and black.

The toner images formed on the photoreceptor drums 1Y, 1M, 1C and 1K are transferred to a predetermined location of an intermediate transfer belt 6 through first transfer rollers 7Y, 7M, 7C and 7K. The intermediate transfer belt 6 is rotatably wound around a plurality of rollers. The toner images are successively transferred from the plurality of photoreceptor drums 1Y, 1M, 1C and 1K onto the intermediate transfer belt 6, and superimposed to form a full-color toner image. The full-color toner image transferred to the intermediate transfer belt 6 is then transferred to a sheet P conveyed with a predetermined timing through a second transfer roller 9 which is in contact with and urged against the intermediate transfer belt 6 to form a transfer nip portion.

The paper feed unit 20 conveys a sheet P along a conveying route of the sheet P. Sheets P are stored in paper feed trays 21, extracted from the paper feed tray 21 by paper feed units 22 and transferred to the conveying route. The sheets P fed from the paper feed tray 21 are successively conveyed by a plurality of intermediate conveyance roller, and reach resist rollers 23. This resist roller 23 starts rotating with predetermined timing in synchronization with the rotation of the intermediate transfer belt 6 bearing a toner image to convey sheets P to the transfer nip portion. The sheets P passed through the transfer nip portion are conveyed to the fixing unit 30.

The fixing unit 30 is a device which performs a fixing process for a sheet P transferred from the transfer nip portion. This fixing process is a process for fixing a toner image to a sheet P through application of heat and pressure. Incidentally, the fixing unit 30 will be described later in details.

Discharging roller 24 receives a sheet P from the fixing unit 30 after a fixing process, and discharges the sheet P to the catch tray 25. On the other hand, when a double-side printing process is performed for forming images on both the front and back sides of a sheet P, rather than a single-side printing process for forming an image only on the front side of a sheet P, a discharging guide conveys sheet P to a paper refeed unit located below after fixing a toner image on the front side of the sheet P. Sheet reversing refeed rollers 26 as a constituent element of the paper refeed unit holds the tail end of the sheet P therebetween and then reverses the sheet P by sending back it to a refeeding conveying route. The sheet P is conveyed through the refeeding conveying route for forming an image on the back side of this sheet P.

Figure 2:
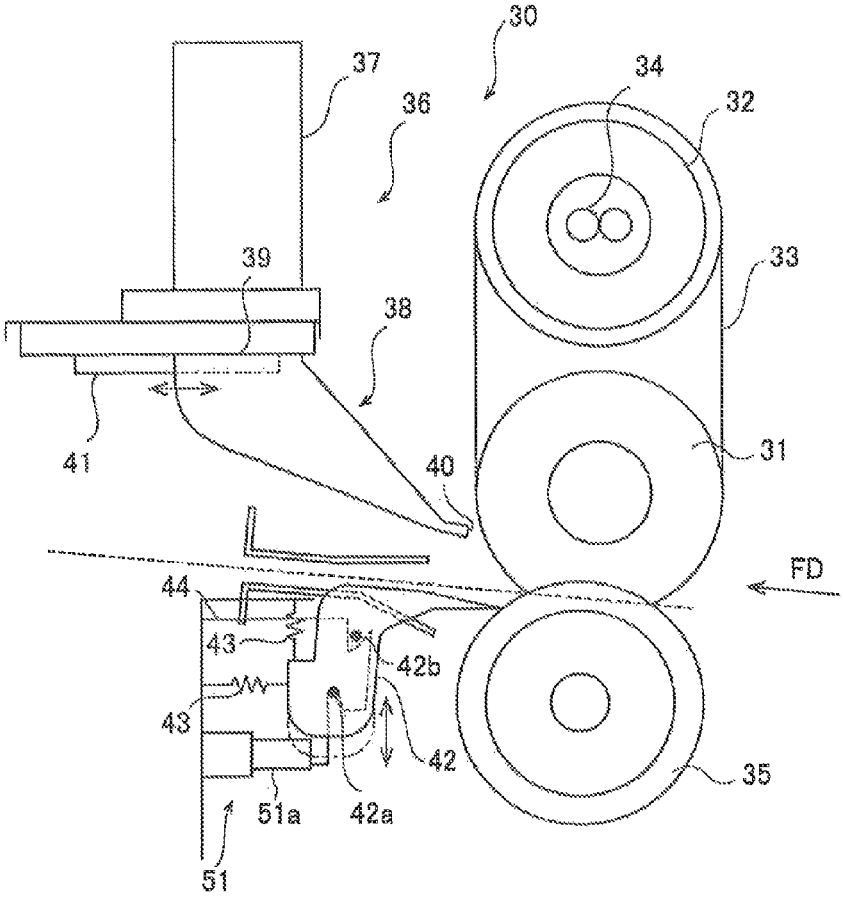
FIG. 2 is a view for schematically showing the main structure of a fixing unit according to the first embodiment of the present invention.

FIG. 2 is a view for schematically showing the main structure of the fixing unit 30. The fixing unit 30 according to the present embodiment includes a fixing unit and a separation unit 36. Incidentally, the separation unit 36 is omitted from the illustration of FIG. 1.

The fixing unit consists of a pair of fixing members which are engaged with each other under pressure to form a fixing nip portion. The fixing unit fixes a toner images to a sheet P by passing the sheet P through the fixing nip portion.

One of the fixing members is located to face the image fixing surface of a sheet P, i.e., the surface to which a toner images has been transferred but has not yet been fixed. In the case of the present embodiment, this fixing member is located above the sheet passing through the fixing nip portion. This one fixing member consists of a pressure roller 31, an upper fixing roller 32 and an endless fixing belt 33. The pressure roller 31 and the upper fixing roller 32 are spaced at a predetermined distance with the fixing belt 33 spanned between these rollers 31 and 32. A heater 34 is installed in the upper fixing roller 32 to heat this upper fixing roller 32. A halogen heater can be used as the heater 34 which is operated by conducting an electric current therethrough. The upper fixing roller 32 is heated through thermal radiation from the heater 34, and then the fixing belt 33 running around this upper fixing roller 32 is heated by the upper fixing roller 32.

The other fixing member is located to face the surface of the sheet P opposite the image fixing surface. In the case of the present embodiment, this other fixing member is located below the sheet passing through the fixing nip portion. This other fixing member consists of a lower fixing roller 35. The lower fixing roller 35 is arranged to face the pressure roller 31 with the fixing belt 33 therebetween, and urged against the pressure roller 31 with a predetermined force. Namely, the lower fixing roller 35 and the pressure roller 31 are engaged under pressure through the fixing belt 33 to form a fixing nip portion between the fixing belt 33 and the lower fixing roller 35.

On the other hand, the separation unit 36 consists of an air blowing unit and a separation claw 42.

The air blowing unit serves to send out separation air for separating a sheet P, which is conveyed through the fixing nip portion, from one of the fixing members, i.e., the fixing belt 33. The air blowing unit is installed in the paper discharging side of the fixing nip portion. Specifically, the air blowing unit consists mainly of an air blower 37 and a duct 38 which are coupled together.

The air blower 37 is, for example, a multiblade fan which is rotatably provided with a number of forward curved vanes. The air blower 37 takes air surrounding the fan into the inside thereof by rotating the forward curved vanes with an electric motor, and sends out the taken air to the duct 38. Meanwhile, the shape and configuration of the fan shall not be limited to the above, and the air blower 37 can be implemented with any other configuration than a fan, for example, a compressor as long as air can be sent out therethrough. Also, another fluid may be used in place of air to blow with the air blower 37.

The duct 38 is a flattened tube which leads air blowing from the air blower 37 to the fixing member. One of openings 39 of the duct 38 is connected to the air blower 37, and the other opening 40 serves as separation air outlet opening (hereinafter referred to also as "separation air outlet opening 40) for directing the taken air towards the fixing member. The duct 33 is arranged in order that the separation air outlet opening 40 faces a sheet P in the discharging side of the fixing nip portion and located in a position offset from the position directly against the sheet P in the fixing nip portion towards the pressure roller 31. Such an arrangement of the duct 38 is based on the knowledge that, of the fixing belt 33 and the lower fixing roller 35, the fixing belt 33 coming in contact with the image fixing surface of the sheet P has a stronger tendency to attract the sheet P therearound than the lower fixing roller 35. In addition, the duct 38 is designed to gradually decrease the flow passage area thereof from the opening 39 near the air blower 37 to the separation air outlet opening 40 for the purpose of increasing the flow velocity of air blowing from the separation air outlet opening 40.

Furthermore, a shutter member 41 is provided at the opening 39 of the duct 38 connected to the air blower 37. This shutter member 41 is made of a plate-like material and shaped corresponding to the opening 39. Also, the shutter member 41 is capable of sliding in a direction perpendicular to the flow of air in the duct 38 and making it possible to freely control the opening area of the opening 39 between its full open state and its closed state in accordance with the sliding position of the shutter member 41. In other words, the shutter member 41 serves as an adjusting unit which adjusts the output of separation air from the air blowing unit by changing the opening area of the opening 39, i.e., the flow passage area of the duct 38. Meanwhile, the location of the shutter member 41 is not limited to the opening 39, but it can be located anywhere in the duct 38. Also, the flow passage area can be adjusted not only by sliding the shutter member 41 but also by rotating a suitable member such as a valve mender which can rotate in the duct 38 to vary the flow passage area.

The separation claw 42 serves to separate a sheet P, which is conveyed through the fixing nip portion, from the other fixing member, i.e., the lower fixing roller 35. The separation claw 42 is located in the paper discharging side of the fixing nip portion. The separation claw 42 is provided because a sheet P can get wrapped around the lower fixing roller 35 depending on the condition of the sheet P, which is conveyed through the fixing nip portion, or under the effect of separation air from the air blowing unit.

Specifically, the separation claw 42 is supported in a predetermined base position by one or more resilient members (two tension springs in this embodiment) 43 which are located between the separation claw 42 and a housing which covers the space surrounding the fixing unit 30. The separation claw 42 is set up in order that the edge thereof abuts onto the lower fixing roller 35 under a predetermined abutting pressure in the base position.

Furthermore, the separation claw 42 is provided with a pair of shafts 42*a* and 42*b* extending in the sheet width direction which is perpendicular to the sheet transportation direction FD. These shafts 42*a* and 42*b* are engaged with grooves formed on a base member 44 which is integrally formed with the aforementioned housing. The base member 44 serves to support the separation claw 42 in the base position with the resilient members 43, and restrict the motion of the separation claw 42 in the vertical direction by the aforementioned grooves which are shaped for this purpose. Because of this, when receiving a force from a sheet P, the separation claw 42 can be displaced only in the vertical direction with the resilient members 43 being resiliently deformed in accordance with the force. Also, when this force is removed, the separation claw 42 returns to the base position by the elastic forces of the resilient members 43.

During conveyance in the fixing unit 30 constructed as described above, a sheet P is passed through the fixing nip portion between the fixing belt 33 and the lower fixing roller 35. A toner image is fixed to the sheet P under the pressure applied between the pressure roller 31 and the lower fixing roller 35 and the heat applied through the fixing belt 33.

On the other hand, the air which is blown from the air blower 37 is sent out to the duct 38, passed through the inside of the duct 38, and then emitted from the separation air outlet opening 40. The air emitted from the separation air outlet opening 40, i.e., the separation air from the separation unit 36 helps a sheet P, which is conveyed through the fixing nip portion, to be separated from the fixing belt 33 (air separation). The separated sheet P is passed through a pair of guide plates located in the downstream side of the fixing nip portion, and conveyed to the discharging rollers 24.

On the other hand, some sheet P may be conveyed out from the fixing nip portion without being separated from the lower fixing roller 35, or may get wrapped around the lower fixing roller 35 even if the sheet P has not be attracted by the lower fixing roller 35 just after ejected from the fixing nip portion. When the sheet P getting wrapped around the lower fixing an 35 reaches the edge of the separation claw 42, the sheet P interferes with the edge of the separation claw 42 (the portion abutting onto the lower fixing roller 35). The sheet P is thereby separated from the lower fixing roller 35. The sheet P which is separated is then passed through a pair of the guide plates and conveyed to the discharging roller 24.

Figure 3:
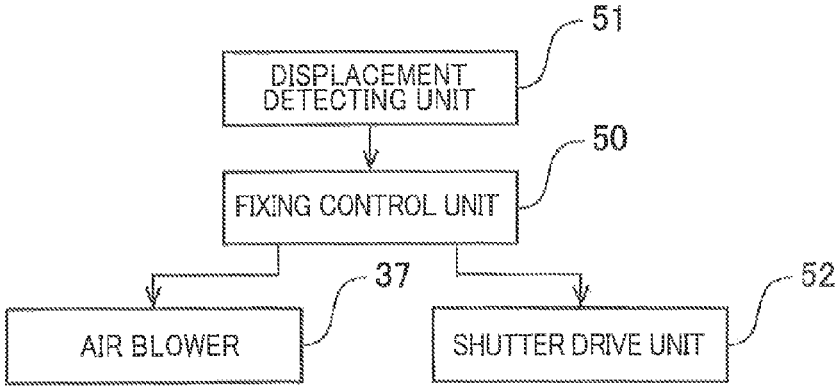
FIG. 3 is a block diagram for schematically showing the structure of the control architecture of the fixing unit shown in FIG. 2.

FIG. 3 is a block diagram for schematically showing the structure of the control architecture of the fixing unit 30. The fixing control unit 50 can be implemented with a microcomputer mainly including a CPU, a ROM, a RAM and an I/O interface. This fixing control unit 50 controls the rotational speed of the fixing belt 33 (the upper fixing roller 32), and controls the energization or input level of the heater 34 in order to maintain the fixing temperature at a predetermined temperature or within a predetermined temperature range. Also, this fixing control unit 50 is capable of communicating with a control unit, which serves to control the image forming apparatus, to start and finish a job by noticing the fixing requirements (fixing speed and temperature) in accordance with the job.

In the case of the present embodiment, the fixing control unit 50 is also capable of controlling the air blower 37 to start and stop blowing separation air. Furthermore, the fixing control unit 50 is capable of selecting the position of the shutter member 41 by controlling a shutter drive unit 52 which slides the shutter member 41. In other words, the fixing control unit 50 controls the flow passage area of the duct 38, and thereby controls the output of separation air, by controlling the shutter drive unit 52. One of the characteristic features of the present embodiment is that the fixing control unit 50 performs the aforementioned control process on the basis of the displacement of the separation claw 42.

The fixing control unit 50 receives a displacement detection signal from a displacement detecting unit 51 to perform the aforementioned control process. The displacement detecting unit 51 is fixedly located on the housing of the fixing unit 30 to detect the displacement of the separation claw 42 in the vertical direction. The displacement detecting unit 51 of the present embodiment is implemented with a single transmission-type optical sensor 51*a* consisting of a light emitting device and a light receiving device. When the separation claw 42 is displaced downwards by a predetermined amount or more from the base position so that the separation claw 42 blocks light emitted from the light emitting device, this transmission-type optical sensor 51*a* detects this displacement as a change in the voltage of the detection signal.

Figure 4:
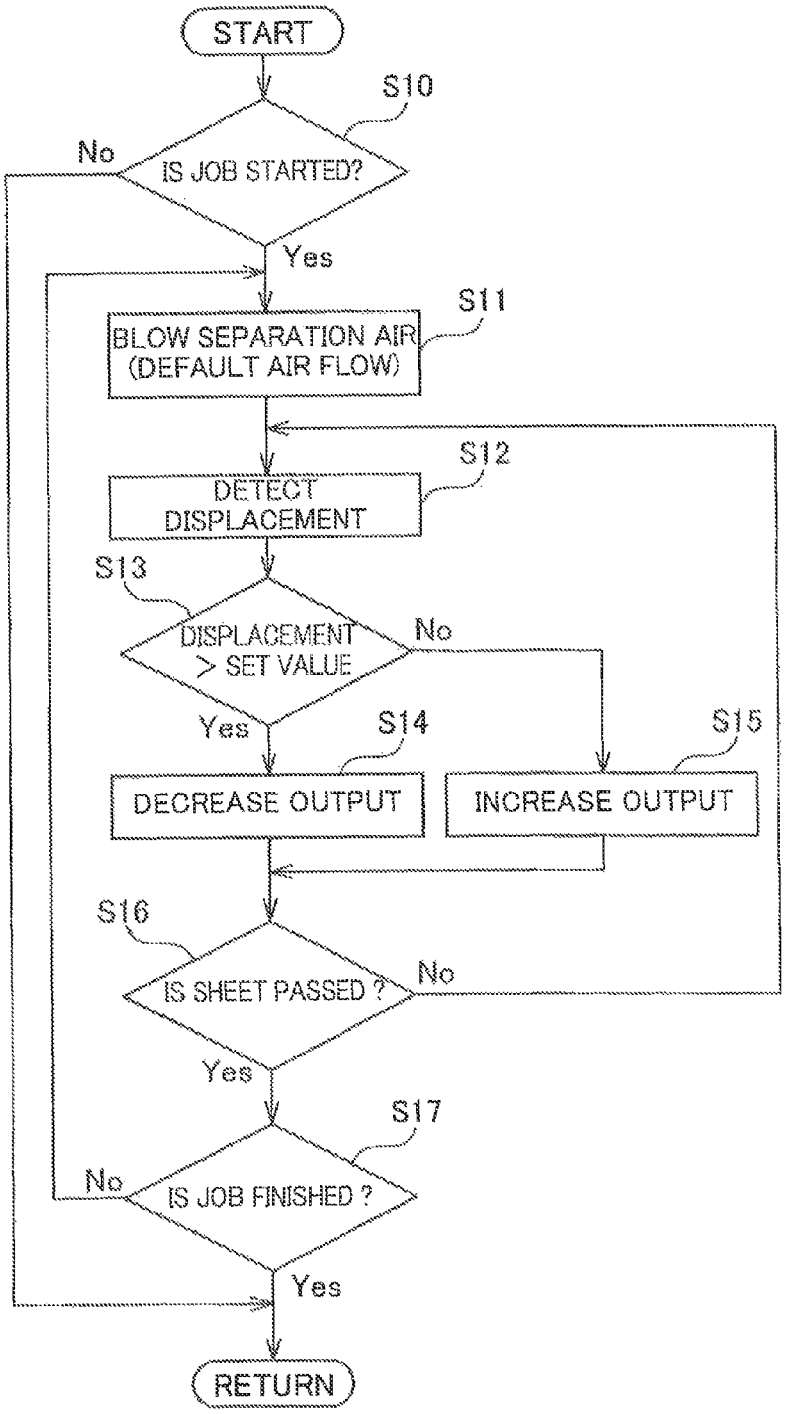
FIG. 4 is a flow chart for showing a series of steps taken during the operation of the fixing unit shown in FIG. 2.

FIG. 4 is a flow chart for showing a series of steps taken during the operation of the fixing unit 30. The process shown in the flow chart is repeatedly called in predetermined cycle, and performed by the fixing control unit 50.

First, in step 10 (S10), the fixing control unit 50 determines whether or not a job is started. If the determination is in the affirmative in step 10, i.e., if a job is started, the process proceeds to step 11 (S11). Conversely, if the determination is in the negative in step 10, i.e., if a job is not started, this routine returns.

In step 11, the fixing control unit 50 starts the operation of the air blower 37 to start blowing separation air. On the other hand, the fixing control unit 50 controls the shutter drive unit 52 to set the position of the shutter member 41 to a predetermined default position. This default position is a position optimally determined in advance through experiments and/or simulations to determine the flow passage area of the duct 38 (for example, about 70% of the maximum area) on the basis of a base value (default value) which is predetermined as the output value for determining the output of separation air. Incidentally, except after the affirmative determination in step 10, the operation of the air blower 37 has been started so that, in step 11, the operation of the air blower 37 is continued.

In step 12 (S12), the fixing control unit 50 detects the displacement of the separation claw 42 through the detection signal from the displacement detecting unit 51. Since the displacement detecting unit 51 of the present embodiment is implemented with the transmission-type optical sensor 51*a*, the fixing control unit 50 detects the displacement of the separation claw 42 as whether or not the separation claw 42 is displaced downwards by the predetermined amount or more from the base position.

In step 13 (S13), the fixing control unit 50 determines whether or not the detected displacement of the separation claw 42 is greater than a set value which is determined in advance. For example, in a scenario that separation air is too strong resulting in an unexpected motion of a sheet P, the separation claw 42 receives a substantial stress from the sheet P which receives an excessive force from the separation air. The stress which the separation claw 42 receives from the sheet P serves as a barometer for determining whether or not the behavior of the sheet P is appropriate.

On the other hand, since the separation claw 42 is supported in the base position by the resilient members 43 in the present embodiment, the stress applied to the resilient member 43 by the displacement of the separation claw corresponds to the stress applied to the separation claw 42, which is considered to correspond to the displacement of the separation claw 42 displaced against the elastic force of the resilient member 43. In other words, the set value in step 13 is used to determine whether or not the behavior of the sheet P receiving separation air is appropriate on the basis of the stress applied to the separation claw 42 (actually, the displacement thereof is used as the parameter of operation). This set value is optimally determined in advance through experiments or simulation.

If the determination is in the affirmative in step 13, i.e., if the displacement of the separation claw 42 is greater than the set value, the process proceeds to step 14 (S14). Conversely, if the determination is in the negative in step 13, i.e., if the displacement of the separation claw 42 is not greater than the set value, the process proceeds to step 15 (S15).

In step 14, the fixing control unit 50 decreases the output of separation air by taking the current stress into consideration. For example, when decreasing the output value for determining the output of separation air, the fixing control unit 50 controls the shutter drive unit 52 to slide the shutter member 41 in order to decrease the flow passage area by an amount which is required corresponding to the output value.

On the other hand, in step 15, the fixing control unit increases the output of separation air by taking the current stress into consideration. For example, when increasing the output value for determining the output of separation air, the fixing control unit 50 controls the shutter drive unit 52 to slide the shutter member 41 in order to increase the flow passage area by an amount which is required corresponding to the output value.

The fixing control unit 50 determines in step 16 (S16) whether or not a sheet P is passed through the fixing unit 30. This determination is made by providing a sensor in the conveying route for detecting a sheet P passed through the fixing unit 30, or by estimating the timing with which a sheet is passed on the basis of the system line speed.

If the determination is in the affirmative in step 16, i.e., if a sheet P is passed through the fixing unit 30, the process proceeds to step 17 (S17). Conversely, if the determination is in the negative in step 16, i.e., if a sheet P is not passed through the fixing unit 30, the process returns to step 12.

In step 17, the fixing control unit 50 determines whether or not the job is finished, i.e., whether or not the sheet P which is determined in step 16 as being passed through the fixing unit 30 is the last sheet of the job. If the determination is in the affirmative in step 17, i.e., if the sheet P which is determined in step 16 as being passed through the fixing unit 30 is the last sheet of the job, this routine returns. Conversely, if the determination is in the negative in step 17, i.e., if the sheet P which is determined in step 16 as being passed through the fixing unit 30 is not the last sheet of the job, this routine is continued by returning to step 11.

According to the present embodiment as has been discussed above, when the displacement detecting unit 51 detects the displacement of the separation claw 42, the fixing control unit 50 controls the shutter drive unit 52 on the basis of the detected displacement of the separation claw 42 to control the output of separation air.

By this configuration, since a sheet P receiving separation air exerts a force on the separation claw 42, it is possible to estimate whether or not the behavior of the sheet P is appropriate by monitoring the displacement of the separation claw 42. Since different types of paper may move in different ways even with the same air flow, the actual behavior of a sheet P may not be effectively estimated by monitoring only air flow. Also, the sheet P which is conveyed can be prevented from moving in an inappropriate condition by controlling the output of separation air, which is a main factor for controlling the behavior of the sheet P, on the basis of the displacement of the separation claw 42. It is therefore possible to prevent shortcomings such as scrapes of images, abrasion of abutting parts and paper jams, and thereby improve print performance.

Furthermore, in accordance with the present embodiment, the separation claw 42 is supported by the resilient members 43 in a predetermined base position, and designed to be displaced from the predetermined base position with the resilient member being resiliently deformed by a force which is exerted on the separation claw 42 by a sheet P.

This configuration can adequately allow the displacement of the separation claw 42, and therefore the displacement can be accurately detected by the displacement detecting unit 51.

Also, the fixing control unit 50 of the present embodiment controls the shutter drive unit 52 in accordance with the stress applied to the separation claw 42 from a sheet P on the basis of the displacement of the separation claw 42 detected by the displacement detecting unit 51.

The behavior of a sheet P receiving separation air is directly reflected in the stress applied to the separation claw 42 from the sheet P. However, this stress can be taken into consideration by the use of the displacement of the separation claw 42 in which the behavior of the sheet P is indirectly reflected. It is therefore possible to control the output of separation air by adequately estimating the behavior of a sheet P receiving separation air.

Also, in accordance with the present embodiment, the shutter member 41 which changes the flow passage area of the duct 38 functions as the adjusting unit which adjusts the output of separation air.

The output of separation air can be adjusted also through the rotational speed of the fan of the air blower 37. However, the output of separation air can be adjusted with a high responsiveness by controlling the flow passage area with the shutter member 41. The responsiveness to the adjusting operation can be enhanced to improve print performance.

Incidentally, the adjusting unit for adjusting the output of separation air can be implemented, other than with the shutter member 41, also with a brake member which adjusts the rotational speed of the fan through the frictional resistance with the rotation shaft of the fan of the air blower 37, or with a regenerative brake which adjusts the rotational speed of the fan by converting rotational energy into electrical energy in the electric motor.

Furthermore, in accordance with the present embodiment, the output of the separation air blowing against a sheet is controlled by the fixing control unit 50 on the basis of the displacement of the separation claw 42 which is caused by this sheet P and detected by the displacement detecting unit 51.

By this configuration, when conveying a sheet P, the output of the separation air blowing against this sheet is controlled on a real time base, and thereby it is possible to improve the print performance.

(Second Embodiment) In what follows, an image forming apparatus according to the second embodiment will be explained. The image forming apparatus of the present embodiment differs from that of the first embodiment in the operation steps of the fixing unit 30. The present embodiment will be explained below mainly with respect to the differences from the first example without repeating redundant description.

Figure 5:
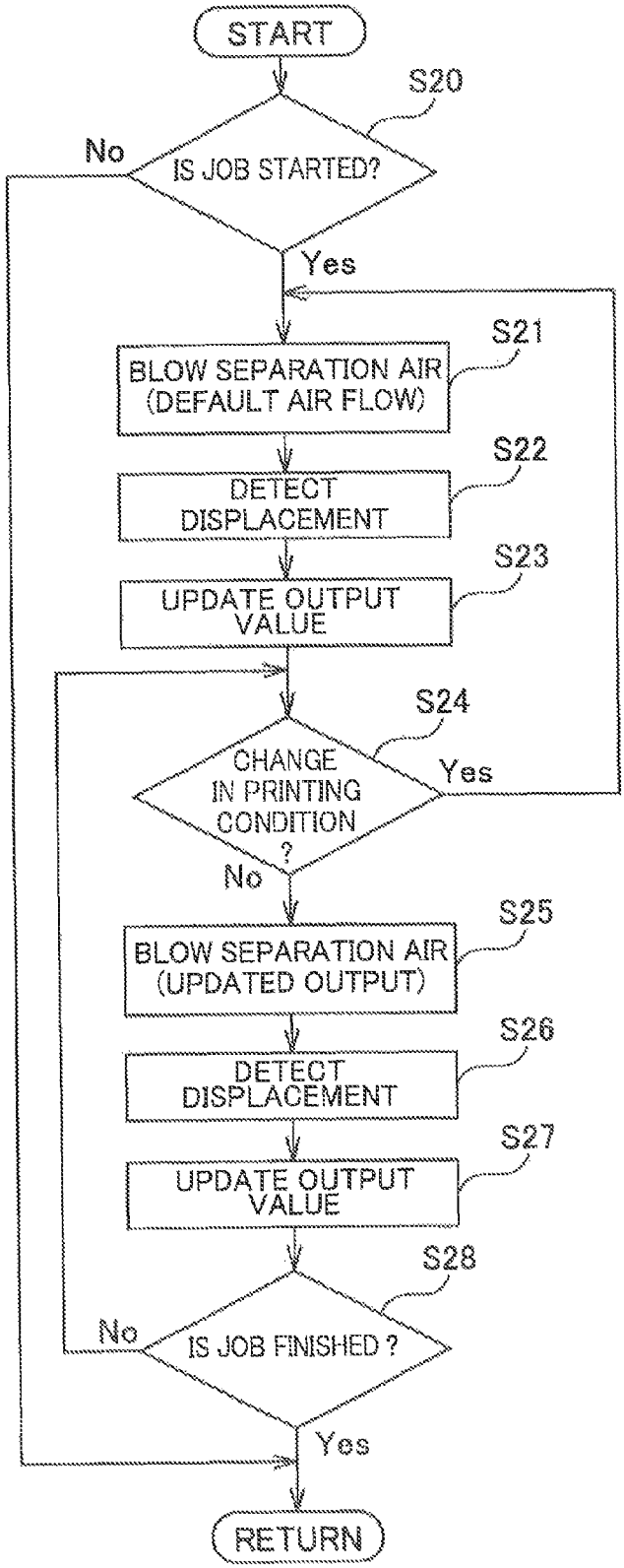
FIG. 5 is a flow chart for showing a series of steps taken during the operation of the fixing unit shown in FIG. 2 according to a second embodiment of the present invention.

FIG. 5 is a flow chart for showing a series of steps taken during the operation of the fixing unit 30. The process shown in the flow chart is repeatedly called in a predetermined cycle, and performed by the fixing control unit 50.

First, in step 20 (S20), the fixing control unit 50 determines whether or not a job is started. If the determination is in the affirmative in step 20, i.e., if a job is started, the process proceeds to step 21 (S21). Conversely, if the determination iamb the negative in step 20, i.e., if a job is not started, this routine returns.

In step 21, the fixing control unit 50 starts the operation of the air blower 37 to start blowing separation air. On the other hand, the fixing control unit 50 controls the shutter drive unit 52 to set the position of the shutter member 41 to a predetermined default position. This default position is a position optimally determined in advance through experiments and/or simulations to determine the flow passage area of the duct 38 (for example, about 70% of the maximum area) on the basis of a base value (default value) which is predetermined as the output value for determining the output of separation air. Incidentally, except after the affirmative determination in step 20, the operation of the air blower 37 has been started so that, in step 21, the operation of the air blower 37 is continued.

In step 22 (S22), the fixing control unit 50 detects the displacement of the separation claw 42 through the detection signal from the displacement detecting unit 51. Since the displacement detecting unit 51 is implemented with the transmission-type optical sensor 51*a* in the same manner as that of the first embodiment, the fixing control unit 50 detects the displacement of the separation claw 42 as whether or not the separation claw 42 is displaced downwards by the predetermined amount or more from the base position.

In step 23 (S23), the fixing control unit 50 updates the output value for determining the output of separation air from the default value. For example, if the detected displacement of the separation claw 42 is greater than a set value which is determined in advance, the output value is updated in order that the output of separation air decreases below the default value. Conversely, if the detected displacement of the separation claw 42 is not greater than the set value which is determined in advance, the output value is updated in order that the output of separation air increases above the default value.

In step 24, the fixing control unit 50 determines whether or not there is a change in printing conditions by comparing the current printing conditions to be used for the subsequent sheet P with the previous printing conditions which was applicable just before the latest execution of step 23. The printing conditions include the type of the sheet P, the image pattern and the like conditions under which the print process is performed. Conversely, if the determination is in the negative in step 24, i.e., if there is not a change in printing conditions, the process proceeds to step 25 (S25).

In step 25, the fixing control unit 50 continues the operation of the air blower 37 to continue to blow separation air. Also, the fixing control unit 50 controls the shutter drive unit 52 to set the sliding position of the shutter member 41 to a predetermined position. This predetermined position is selected to set the flow passage area of the duct 38 in order that the output of separation air blowing from the separation air outlet opening 40 corresponds to the output value updated in step 23 or step 27.

In step 26 (S26), the fixing control unit 50 detects the displacement of the separation claw 42 through the detection signal from the displacement detecting unit 51 in the same manner as in step 22.

In step 27 (S27), the fixing control unit 50 updates the output value for determining the output of separation air from the current value. For example, if the detected displacement of the separation claw 42 is greater than a set value which is determined in advance, the output value is updated in order that the output of separation air decreases below the current value. Conversely, if the detected displacement of the separation claw 42 is not greater than the set value which is determined in advance, the output value is updated in order that the output of separation air increases above the current value.

In step 28 (S28), the fixing control unit 50 determines whether or not the job is finished, i.e., whether or not the sheet P which is passed through the fixing unit 30 after the latest detection of displacement in step 26 is the last sheet of the job. If the determination is in the affirmative in step 28, i.e., if the sheet P is the last sheet of the job, this routine returns. Conversely, if the determination is in the negative in step 28, i.e., if the sheet P is not the last sheet of the job, this routine is continued by returning to step 24.

As has been discussed above, on the basis of the displacement of the separation claw 42 which is caused by a sheet P and detected by the displacement detecting unit 51, fixing control unit 50 controls the output of the separation air blowing against the subsequent sheet.

In accordance with this configuration, since the control applicable to sheets P is switched, the operation load on the fixing control unit 50 can be lessened while improving the print performance in comparison with the case where the output of separation air is not controlled.

Figure 6:
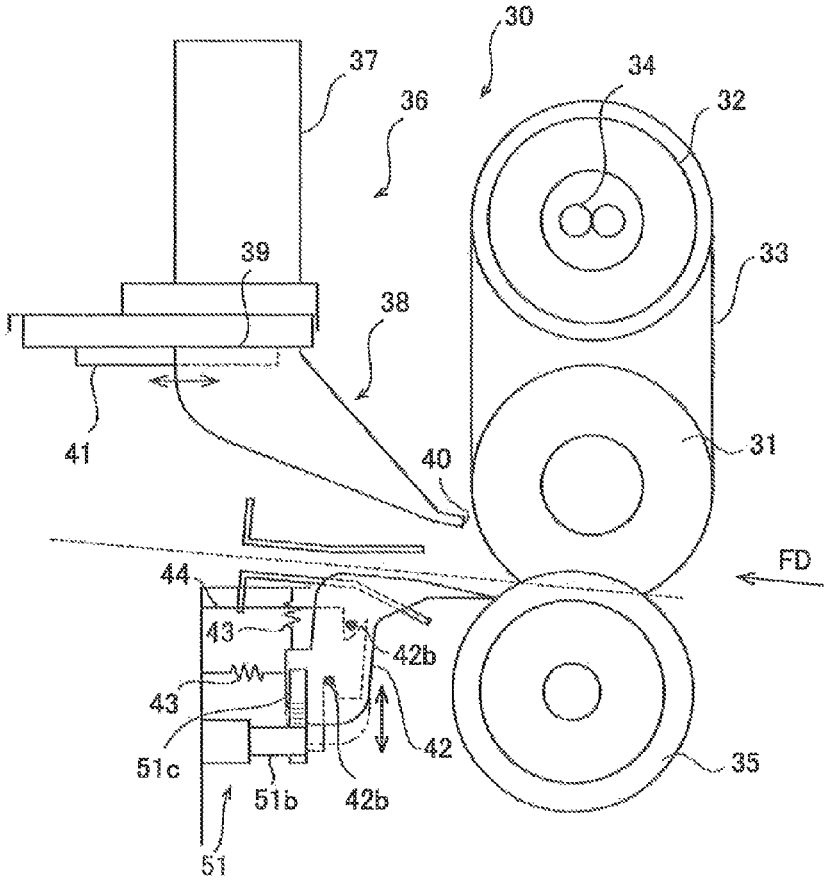
FIG. 6 is a view for schematically showing the main structure of a fixing unit according to a third embodiment of the present invention.

(Third Embodiment) FIG. 6 is a view for schematically showing the main structure of a fixing unit 30 in accordance with the third embodiment of the present invention. The fixing unit 30 of this third embodiment differs from those of the above embodiments in the configuration of a displacement detecting unit 51.

Specifically, the displacement detecting unit 51 is implemented with an encoder. This encoder is a device which detects the position of a scale which is displaced integrally with a moving member and outputs the displacement as positional information. Such a device may be an optical encoder, an magnetic encoder or the like. For example, the encoder serving as the displacement detecting unit 51 consists of a head 51*b* for detecting positional information and a scale 51*c* in the form of a linear member which can be read by the head 51*b*. In this case, while the head 51*b* is statically provided on the housing of the fixing unit 30, the scale 51*c* is mounted on the separation claw 42 and oriented in the moving direction of the separation claw 42. The head 51*b* detects the position of the separation claw 42 by optically or magnetically detecting a slit member or a slit area continuously formed on the scale 51*c* in the longitudinal direction.

On the other hand, the fixing control unit 50 saves a table or a calculation formula used to determine the output value for determining the output of separation air corresponding to each displacement detected by the displacement detecting unit 51. The fixing control unit 50 determines the output value corresponding to the detected displacement, and slides the shutter member 41 by controlling the shutter drive unit 52 in accordance with this output value.

In accordance with the present embodiment, the displacement of the separation claw 42 can be detected by the displacement detecting unit 51 with a high resolution. It is thereby possible to adequately adjust the output of separation air in accordance with the displacement.

Incidentally, while the above embodiments have been described with the separation claw 42 which is displaced in the vertical direction, the present invention is not limited thereto. As long as displaced in response to the behavior of a sheet P, the separation claw 42 can be designed to be displaced in a rotation direction or any other direction.

The foregoing description has been presented on the basis of the image forming apparatus according to the present invention. However, it is not intended to limit the present invention to the precise form described, and obviously many modifications and variations are possible within the scope of the invention. Furthermore, the present invention can be considered to relate also to the fixing unit itself as a part of the image forming apparatus.

The invention claimed is:

1. A fixing unit comprising:

a fixing unit having a pair of fixing members engaged with each other under pressure to form a fixing nip portion through which a sheet is passed to fix an image to this sheet;

an air blowing unit configured to output separation air for separating the sheet passed through said fixing nip portion from said fixing member;

an adjusting unit configured to adjust the output of said separation air;

a separation claw configured to separate the sheet passed through said fixing nip portion from said fixing member;

a detecting unit configured to detect the displacement of said separation claw; and a control unit configured to control the output of said separation air by controlling said adjusting unit on the basis of the displacement of said separation claw detected by said detecting unit.

2. The fixing unit of claim 1 wherein said separation claw is supported by a resilient member in a predetermined base position, and designed to be displaced from the predetermined base position with said resilient member being resiliently deformed by a force which is exerted on said separation claw by the sheet.

3. The fixing unit of claim 1 wherein said air blowing unit comprising:

an air blower configured to blow air; and a duct configured to lead the air blown from said air blower to an outlet opening, wherein said adjusting unit is a shutter member which changes the flow passage area of said duct.

4. The fixing unit of claim 1 wherein said air blowing unit is an air blower which blows a fluid by rotating a fan, and wherein said adjusting unit is a brake member which adjusts the rotational speed of said fan through the frictional resistance with the rotation shaft of said fan.

5. The fixing unit of claim 1 wherein said air blowing unit is an air blower which blows a fluid by rotating a fan with an electric motor, and wherein said adjusting unit is a regenerative brake which adjusts the rotational speed of said fan by converting rotational energy into electrical energy in said electric motor.

6. The fixing unit of claim 1 wherein the output control of said separation air on the basis of the displacement of said separation claw detected by said detecting unit is used to control separation air blowing against a sheet subsequent to the sheet that caused the displacement of said separation claw.

7. An image forming apparatus comprising:

an image forming unit configured to transfer an image to a sheet; and a fixing unit configured to fix the transferred image to the sheet, said fixing unit comprising:

a fixing unit having a pair of fixing members engaged with each other under pressure to form a fixing nip portion through which a sheet is passed to fix an image to this sheet;

an air blowing unit configured to output separation air for separating the sheet passed through said fixing nip portion from said fixing member;

an adjusting unit configured to adjust the output of said separation air;

a separation claw configured to separate the sheet passed through said fixing nip portion from said fixing member;

a detecting unit configured to detect the displacement of said separation claw; and a control unit configured to control the output of said separation air by controlling said adjusting unit on the basis of the displacement of said separation claw detected by said detecting unit.

8. The image forming apparatus of claim 7 wherein said separation claw is supported by a resilient member in a predetermined base position, and designed to be displaced from the predetermined base position with said resilient member being resiliently deformed by a force which is exerted on said separation claw by the sheet.

9. The image forming apparatus of claim 7 wherein said air blowing unit comprising:

an air blower configured to blow air; and a duct configured to lead the air blown from said air blower to an outlet opening, wherein said adjusting unit is a shutter member which changes the flow passage area of said duct.

10. The image forming apparatus of claim 7 wherein said air blowing unit is an air blower which blows a fluid by rotating a fan, and wherein said adjusting unit is a brake member which adjusts the rotational speed of said fan through the frictional resistance with the rotation shaft of said fan.

11. The image forming apparatus of claim 7 wherein said air blowing unit is an air blower which blows a fluid by rotating a fan with an electric motor, and wherein said adjusting unit is a regenerative brake which adjusts the rotational speed of said an by converting rotational energy into electrical energy in said electric motor.

12. The image forming apparatus of claim 7 wherein the output control of said separation air on the basis of the displacement of said separation claw detected by said detecting unit is used to control separation air blowing against a sheet subsequent to the sheet that caused the displacement of said separation claw.

* * * * *